United States Patent [19]

Jung

[11] 4,092,777

[45] June 6, 1978

[54] CUTTING-OUT MACHINE FOR FLAT MATERIAL

[75] Inventor: Rolf Jung, Waiblingen, Germany

[73] Assignee: Krauss u. Reichert GmbH & Co. KG Spezialmaschinenfabrik, Waiblingen, Germany

[21] Appl. No.: 776,355

[22] Filed: Mar. 10, 1977

[30] Foreign Application Priority Data

Jan. 26, 1977 Germany ..... 2703066
Mar. 16, 1976 Germany ..... 7608012[U]

[51] Int. Cl.[2] ..... B26B 7/00
[52] U.S. Cl. ..... 30/273
[58] Field of Search ..... 30/273, 272 R

[56] References Cited

U.S. PATENT DOCUMENTS

| | | | |
|---|---|---|---|
| 499,917 | 6/1893 | Froemert | 30/273 |
| 520,598 | 5/1894 | Howe | 30/273 |
| 578,382 | 3/1897 | Wolf | 30/273 |

*Primary Examiner*—Robert C. Watson
*Attorney, Agent, or Firm*—Kenway & Jenney

[57] ABSTRACT

A cutting-out machine for flat material such as cloth has a slit blade cutting mechanism mounted on one end of a double-arm beam. The beam arms are pivotally connected to one another about a vertical axis. The cutting mechanism is pivotally connected to one end of the beam, preferably in an adjustable spring-loaded mount. The pivot axis is vertical and aligned with the cutting edge of the slit blade. The other end of the beam is pivotally connected, also along a vertical axis, to a carriage that rides on guide tracks extending along a longitudinal edge of a support table for the material. The carriage is preferably driven by an electric motor under the control of a switch located on the cutting mechanism. The beams arms are substantially equal to the width of the support table when the beam is fully extended.

9 Claims, 5 Drawing Figures

Figure 1:
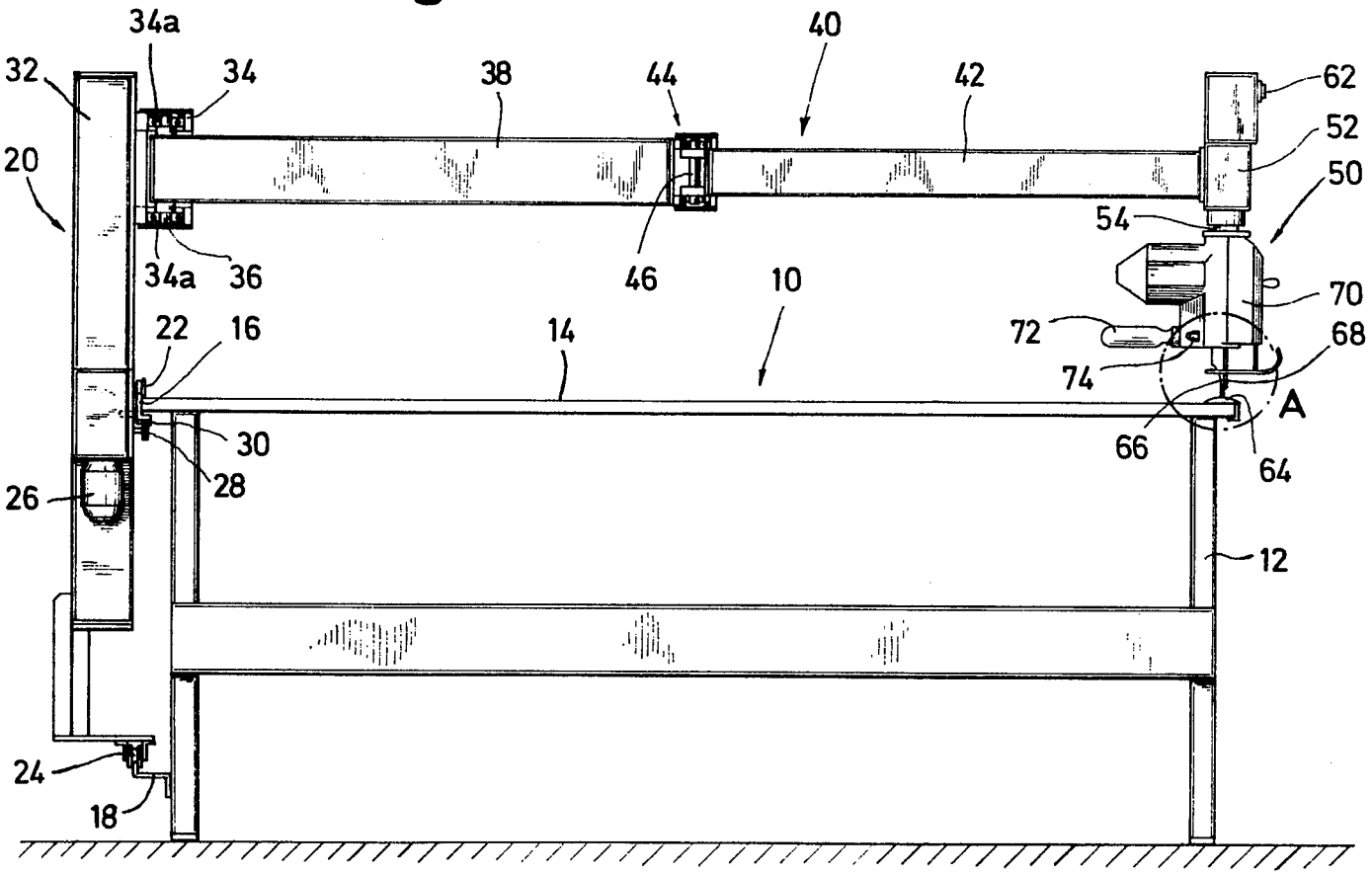

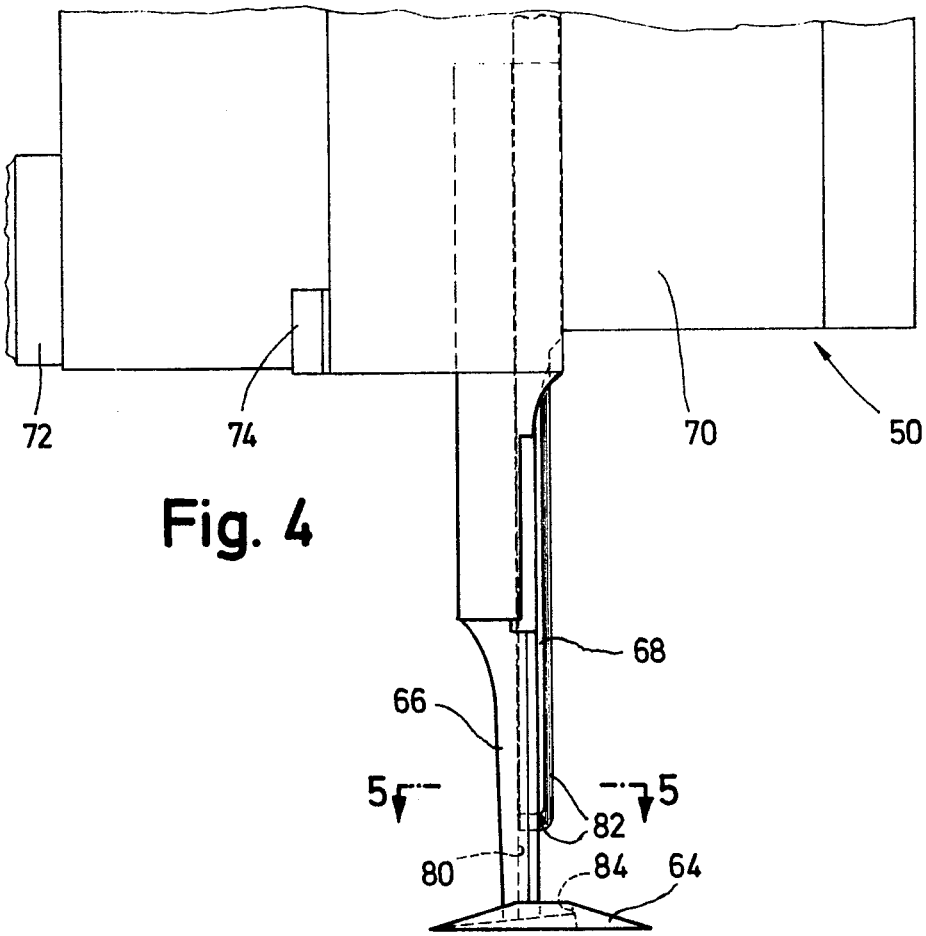
Fig. 4
Fig. 5
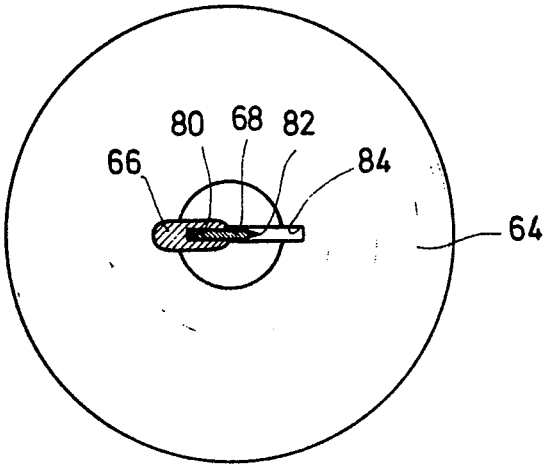

CUTTING-OUT MACHINE FOR FLAT MATERIAL

The invention relates to a cutting-out machine for flat material, in particular a cloth cutting-out machine.

It is known to make use of hand-guided slitting blade machines for the cutting-out of flat material, e.g. cloth layers, plastics material foils and the like. The most usual hand-guided slitting blade machines are supported on a baseplate which has rollers on its underside, so that the machine may be pushed more easily over the surface of a table on which the flat material which is to be cut out has been laid out. Protracted cutting-out with these hand-guided slitting blade machines is exhausting however, because they are relatively heavy, primarily due to the weight of an electric motor used to drive the slitting blade. The weight of the motor and its housing also leads to another disadvantage however. An upright support of generally U-shaped cross-section on which rest the housing and the driving motor and which accommodates the slitting blade, is secured on the base plate. The weight of the housing and motor requires are relatively robust support, and since its dimension transversely to the direction of movement or feed cannot be too large, conventional hand-guided slitting blade machines have a support of substantial width in side elevation. For this reason, acute corners of a cut-out cannot be followed in a continuous movement with these slitting blade machines and it is necessary firstly to cut beyond a corner and then to pull back under simultaneously turning of the slitting blade machine. A similar situation applies in the forming of so-called incision markings, which are small incisions extending at right angles to the outline of a cut-out.

A cutting-out machine is already known however (U.S. Pat. No. 2,998,651) in which a manually displaceable carriage is guided for movement along rails positioned adjacent a longitudinal edge of a table forming the support for the flat material. The carriage has a vertical post around which is pivotally mounted a rigid beam extending above the table. The beam forms a guide for a carriage which is displaceable and carries a vertical spindle extending in the direction towards the table, a slitting blade mechanism and an electric motor driving the slitting blade are suspended from the spindle for pivotal movement therearound.

If the slitting blade mechanism is guided by hand, the latter may be pivoted around the spindle, or moved along the beam, in a relatively effortless manner, the latter however only when the handle mounted on the slitting blade mechanism extends horizontally in the longitudinal direction of the beam, since a torque preventing the relative turning of the slitting blade arrangement must be applied on the handle at the same time during movement of the slitting blade mechanism along the beam. The same also applies for a pivotal movement of the slitting blade mechanism around the vertical post, provided that the handle is not aligned tangentially to the corresponding arc around the post. Even more costly in terms of power, are particular combinations of the three movements consisting of pivoting the slitting blade mechanism around its axis, movement of the slitting blade mechanism along the beam, and pivoting of the beam around the vertical post, which becomes apparent if one considers the example in which the direction of the line which is to be cut subtends an angle with the longitudinal direction of the beam, which differs relatively little from 90°, because not only must the beam then be pivoted around the vertical post and the slitting blade mechanism around its axis, but the slitting blade mechanism must also be moved along the beam. The pushing force which is applied on the handle of the slitting blade mechanism has a small component only in the longitudinal direction of the beam however, and the frictiional forces occurring during the movement of the slitting blade mechanism along the beam are increased by the component acting at right angles to this direction.

The known structure has its greatest disadvantages however if it is intended to produce a cutting line which extends close to the longitudinal table edge facing away from the rails and approximately parallel to the edge, since, for reasons of space, the length of the beam is at most, approximately equal to the table width, the traversal of such a cutting line requires a displacement of the carriage carrying the post. Due to the free pivoting of the beam around the post however, a force acting in the longitudinal direction of the table cannot be transmitted to the carriage bearing the post, disregarding the rare casse when the beam extends approximately in the longitudinal direction of the table and the carriage bearing the slitting blade mechanism spindle is situated at the free end of the beam.

The object of the present invention is to provide a cutting-out machine which overcomes the disadvantages and difficulties referred to above.

The present invention consists in a cutting-out machine for flat material comprising a support for the flat material, and a cutting mechanism mounted on a beam positioned above the support and pivotable around a vertical axis, said beam having at least two arms which are interconnected by a joint having a vertical joint axis. The movement of the carriage along the beam, as well as the pivoting of the slitting blade mechanism around the vertical post of the known cutting-out machine, are replaced in the present invention by two pivotal displacements, to which is also added a third pivotal displacement around the axis of the cutting device. Since in the present invention a displacement of the cutting device along required lines thus always results only in pivotal displacements of the two arms, that is around axes which are mutually parallel, the cutter mechanism may easily be displaced in required directions.

Basically, the beam can be assembled in different ways from several arms coupled to each other, for example, it could have the form of a parallelogram, or of a lazy-tongs structure, or the like. It is least complicated however if the beam has two arms only, which are coupled to each other and whereof one is pivotably arranged around a vertical axis in another joint. Clearly, the arms should be so dimensioned as to provide an adequate radius of operation for the cutter mechanism.

Since it is obviously desirable to produce the beam as light in weight as possible with a view to achieve easy actuation, an object is to avoid making the arms of the beam particularly long in order to obtain a maximum radius of operation of the cutter mechanism. With this in view it is also advisable to mount the beam on a carriage movable along the support, which carriage is only moved when the cutting operations have been completed in one area of the support, so that the operation may be continued in an adjacent area.

In the known cutting-out machine disclosed in U.S. Pat. No. 2,998,651, the carriage bearing the vertical post must be displaced manually and an electric switch for the slitting blade driving motor is positioned adjacent the handle of the slitting blade mechanism.

In a preferred embodiment of the present invention, the carriage has an electric drive and a control device for the electric drive is positioned at the extremity of the beam adjacent the cutting device, or on the cutting device itself.

Since the slitting blade support need no longer carry the actual slitting blade mechanism, it may have such small dimensions that it permits uninterrupted cutting around even acture corners as well as of a brief pivoting action for forming incision markings. Furthermore, a base plate which may be secured at the bottom of the slitting blade support, may also be produced substantially smaller than in the case of the known machines which equally has an advantageous efffect on the expenditure of the power required during a cutting-out operation.

Not only may the slitting blade machines described above be considered as a cutting device, but also all other known devices for the cutting-out of flat material, thus for example the cutting devices may be in the form of a sharply delineated water jet issuing under high pressure.

Figure 2:
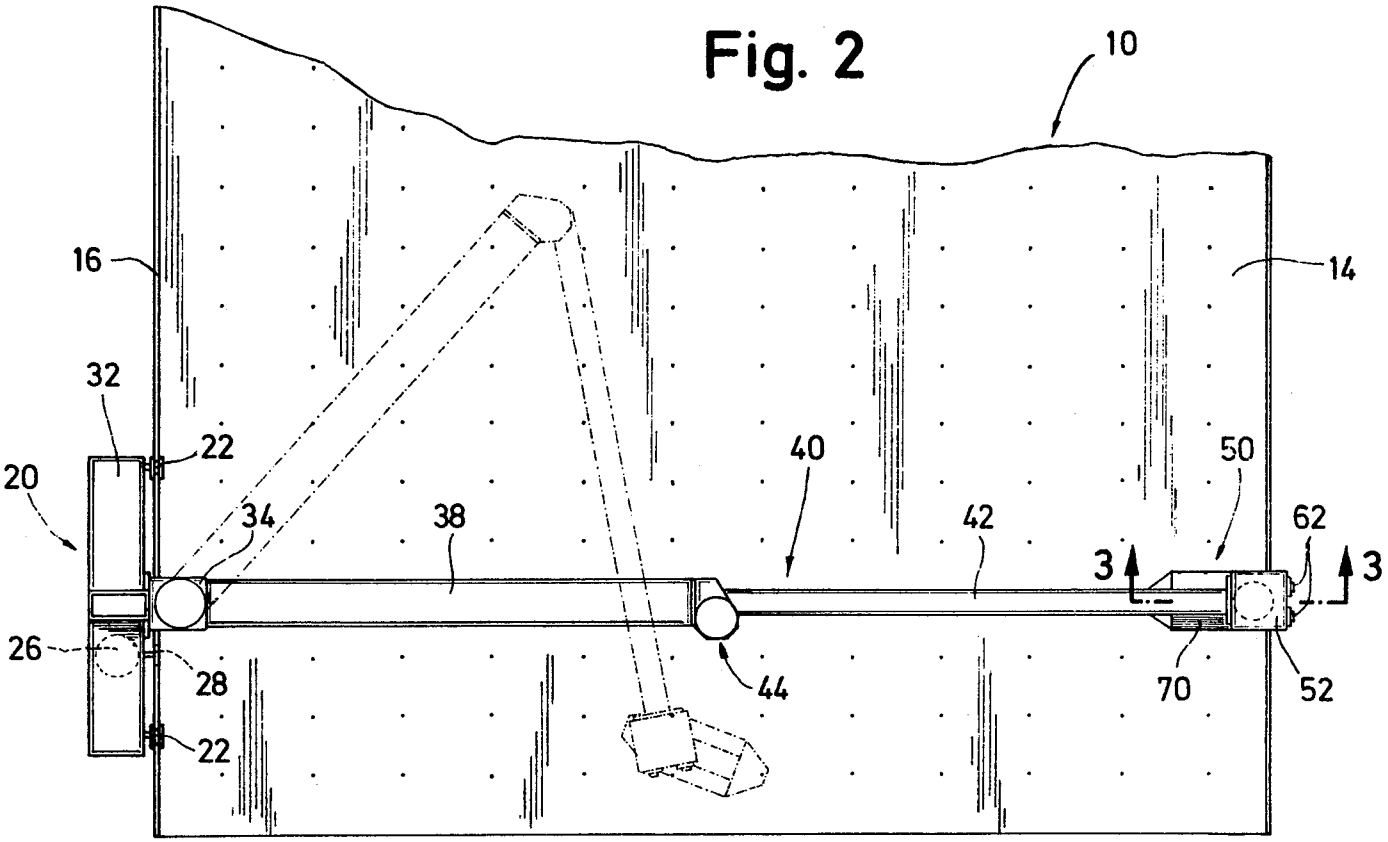
Figure 3:
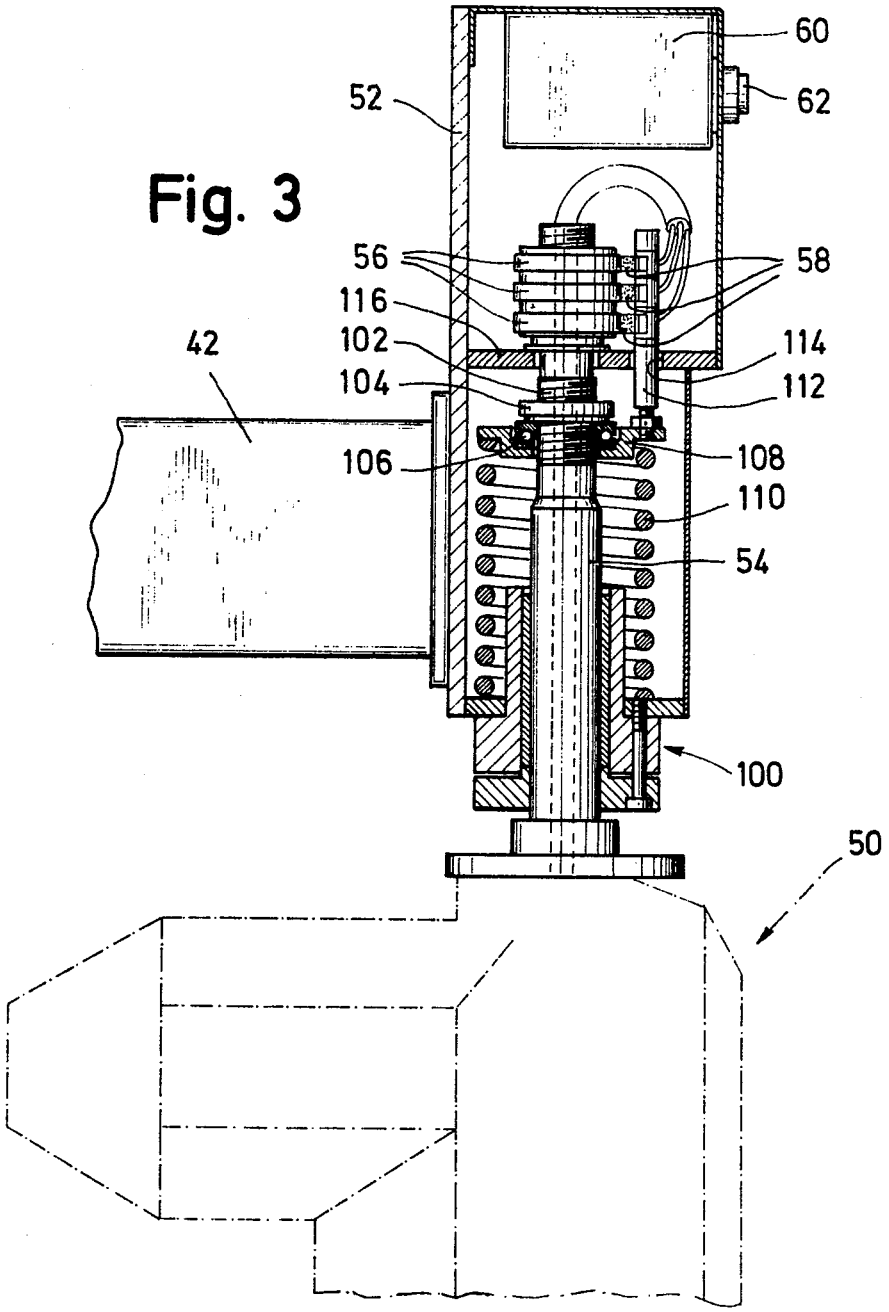

In the accompanying drawings:

FIG. 1 is an end view of a first embodiment of a cutting-out machine according to the present invention shown with the beam extended, FIG. 2 is a plan view of the machine shown in FIG. 1, the beam also being illustrated in an angled position by dot-dash lines, FIG. 3 is a cross-section through the extremity of the beam taken along the line 3—3 of FIG. 2, FIG. 4 is a detail of the portion marked "A" in FIG. 1, FIG. 5 is a cross-section through the support for the slitting blade taken along the line 5—5 of FIG. 4, and The cutting-out machine illustrated in FIGS. 1 to 5 comprises a table 10 which has a base frame 12 and a table panel 14. The latter provides a support for the flat material which is to be cut out, which may for example consist of several superimposed layers of textile fabrics, plastics material foils, leather, artificial leather or the like. At the left side of the table as viewed in FIG. 1, an upper rail 16 of L-shaped cross-section is fastened on the edge of the table panel, and a lower rail 18 of generally Z-shaped cross-section is secured on the base frame, both rails extending the length of the table. A carriage 20 has two pairs of horizontally spaced wheels 22 and 24 respectively engaging the rails 16 and 18 for movement therealong, each wheel having a tread. The carriage is driven by a geared electric motor 26 having a pinion 28 which co-operates with a toothed rack 30 on the underside of the upper rail 16.

The carriage 20 carries an upwardly extending post 32 provided with a bearing housing 34 at its upper end which accommodates spaced bearings 34*a*. A spindle 36 journalled in the bearing 34*a* is immovable vertically but is pivotable around a vertical axis. The spindle 36 carries one arm 38 of a beam 40 which also has another arm 42. These two arms 38, 42 are interconnected by a centrally disposed joint 44, in such manner that they may be pivoted relatively to each other around a vertical spindle 46.

A slitting blade mechanism 50 is suspended from the free extremity of the arm 42. As apparent from FIG. 3, a spindle 54 carrying the slitting blade mechanism 50 is rotatably journalled in a housing 52 positioned on the end of the arm 42. The upper portion of the spindle 54 carries slip rings 56 insulated from one another and current is fed to the electric motor (not shown) of the slitting blade mechanism 50 via the slip rings and brushes 58. The spindle 54 is rotatably and displaceably journalled in a bush 100 secured on the lower end of the housing 52. A screw-threaded portion 102 of the spindle 54 carries a ring 104 provided with an internal screw-thread, which bears against an axial bearing 106 carried by a spring retainer 108 which engages a coil spring 110 bearing against the bottom of the housing and surrounding the spindle 54. A rod-shaped brush carrier 112 is displaceably guided in a bore 114 of an intermediate partition 116 of the housing 52 and fastened to the spring retainer 108, so that the brushes 58 are displaced with the spindle 54 and thereby with the slip rings 56. The coil spring 110 is so rated that it approximately balances the weight of the slittng blade mechanism 50. An electric control system 60 for the geared motor 26 is positioned in the upper portion of the housing 52 and includes two pushbutton switches 62 for selection of the two directions of travel of the carriage 20.

Apart from a base plate 64, a support 66 and a slitting blade 68, the slitting blade mechanism 50 is of conventional construction. A handle 72 for guiding the mechaism 50 and an on-off switch 74 for the slitting blade driving motor are mounted on the housing 70 of the slitting blade mechanism 50.

The ring 104 is so adjusted that the base plate 64 is positioned at the level of the upper surface of the table panel 14. Due to the coil spring 110, a precise setting is unncessary, since the effect of the spring is that the base plate bears on the table panel 14 with little contact force, thus runners are not required on the underside of the base plate. The support 66 mounting the base plate 64 has a longitudinal groove 80 (see FIGS. 4 and 5) in which the slitting blade 68 is guided. The latter has a cutting edge 82 not only on its leading edge but also on its lower extremity which passes into a corresponding slot 84 of the base plate 64, so that a cleaver-like cutting action results i.e. the slitting blade mechanism penetrates with its base plate 64 beneath the flat material which is to be cut. As may be seen from FIGS. 4 and 5, (which are true to scale) the support 66 has a width of 6 to 7 mms and a thickness of approximately 5 mms only in the portion which slides through the flat material to be cut out, and in combination with a slitting blade of a width of approximately 6 mms, which projects from the support by approximately 2 mms, it is also possible to run continuously around sharp corners as well as produce incision markings by brief pivoting of the slitting blade mechanism, so that the above dimensions are optimum.

The centre of the spring 54 is positioned above the front edge of the cutting edge 82 of the slitting blade 68. It is advantageous however if the spindle is set back slightly with respect to the cutting edge, since incision markings may then be produced simply by a pivoting of the slitting blade mechanism. The slitting blade mechanism need not be provided with a base plate which penetrates beneath the flat material to be cut out, since the support and the base plate need not actually bear the weight of the slitting blade mechanism.

What we claim is:

1. A cutting-out machine for flat material, especially a cloth cutting machine, comprising in combination:

a support means for the flat material;

guide means mounted lengthwise of that support means;

a beam positioned above that support means and pivotable around a vertical axis being mounted on a carriage which is movable along the guide means lengthwise of that support means, that beam having at least two arms which are interconnected by a joint having a vertical joint axis, a first one of that arms being pivotable around the vertical beam axis and a second one of that arms having a free end opposite to its end interconnected with that first arm;

a cutting mechanism mounted at the free end of that second arm and being pivotable around a vertical axis being substantially coincident with a cutting edge of a cutter element of that cutting mechanism;

the length of that first and second arms being such that the entire length of that completely extended beam is substantially equal to the width of that support means in a direction perpendicular with respect to that guide means.

2. A cutting-out machine according to claim 1, wherein the carriage has an electric drive.

3. A cutting-out machine according to claim 2, wherein a control device for the electric drive is positioned at the extremity of the beam adjacent the cutting device.

4. A cutting-out machine according to claim 2 wherein a control device for the electric motor is positioned on the cutting mechanism itself.

5. A cutting-out machine according to claim 1 wherein the cutting arrangement is suspended from the beam by means of a spring.

6. A cutting-out machine according to claim 5, wherein the spring has an adjustable abutment.

7. A cutting-out machine according to claim 1 wherein a guide of a slitting blade has a width of between 4 to 10 mms and, at the lower extremity, a width of between 5 to 7 mms.

8. A cutting-out machine according to claim 1 wherein a base plate of a slitting blade mechanism has a diameter of between 30 to 45 mms.

9. A cutting-out machine according to claim 7, wherein in side elevation, the slitting blade has a width of between 4 to 8 mms.

* * * * *